US007256661B2

(12) United States Patent
Chen et al.

(10) Patent No.: US 7,256,661 B2
(45) Date of Patent: Aug. 14, 2007

(54) MULTI-CHANNEL CIRCULATOR/ISOLATOR APPARATUS AND METHOD

(75) Inventors: Ming Chen, Kent, WA (US); Jimmy S Takeuchi, Mercer Island, WA (US); Douglas A Pietila, Puyallup, WA (US)

(73) Assignee: The Boeing Company, Chicago, IL (US)

( * ) Notice: Subject to any disclaimer, the term of this patent is extended or adjusted under 35 U.S.C. 154(b) by 166 days.

(21) Appl. No.: 11/102,923

(22) Filed: Apr. 8, 2005

(65) Prior Publication Data

US 2006/0226924 A1 Oct. 12, 2006

(51) Int. Cl.
*H01P 1/387* (2006.01)

(52) U.S. Cl. ..... 333/1.1; 333/24.2

(58) Field of Classification Search ..... 333/1.1, 333/24.2

See application file for complete search history.

(56) References Cited

U.S. PATENT DOCUMENTS 5,185,587 A * 2/1993 Kurian et al. ..... 333/1.1
6,563,394 B1 * 5/2003 Kudo ..... 333/1.1
2002/0135434 A1 * 9/2002 Emanuelsson ..... 333/1.1
2002/0190808 A1 * 12/2002 Paquette et al. ..... 333/1.1

* cited by examiner

*Primary Examiner*—Stephen E. Jones
(74) *Attorney, Agent, or Firm*—Harness, Dickey & Pierce, P.L.C.

(57) ABSTRACT

A multi-channel circulator or isolator well suited for use in phased array antennas or other RF devices where space and packaging constraints make the implementation of a conventional circular or isolator difficult or impossible. The multi-channel circulator/isolator can be configured as an isolator by the inclusion of one or more load resistors at one of its ports. In various configurations two or more ferrite substrates are provided that each provide a plurality of transmission ports. One or more permanent magnets are used to simultaneously provide the magnetic flux field through both of the substrates. The substrates can be configured such that they are spaced apart by a small distance, or positioned face to face in contact with one another. One or a plurality of magnets can be used depending upon RF requirements. Each substrate forms an independent electromagnetic wave propagation channel that limits the propagation of RF energy between its ports in one direction only.

14 Claims, 7 Drawing Sheets

FIG 3
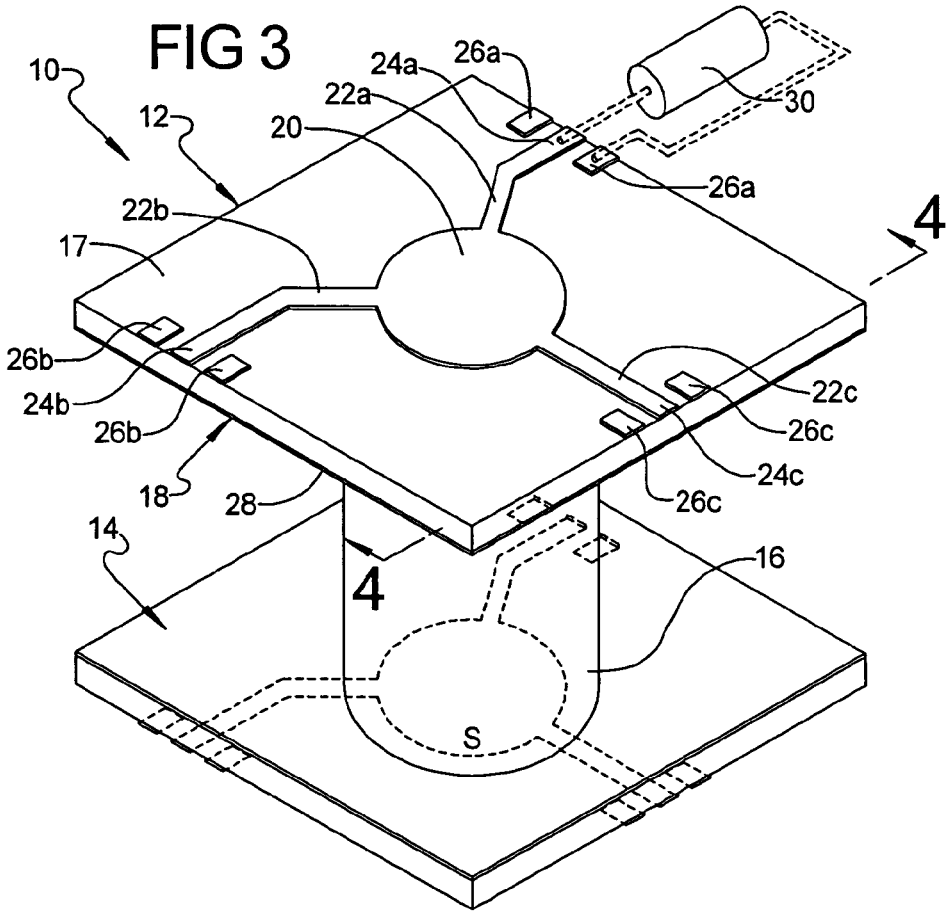
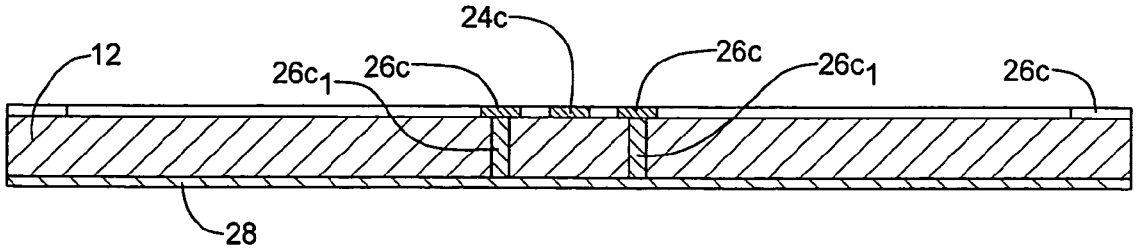
FIG 4

FIG 5
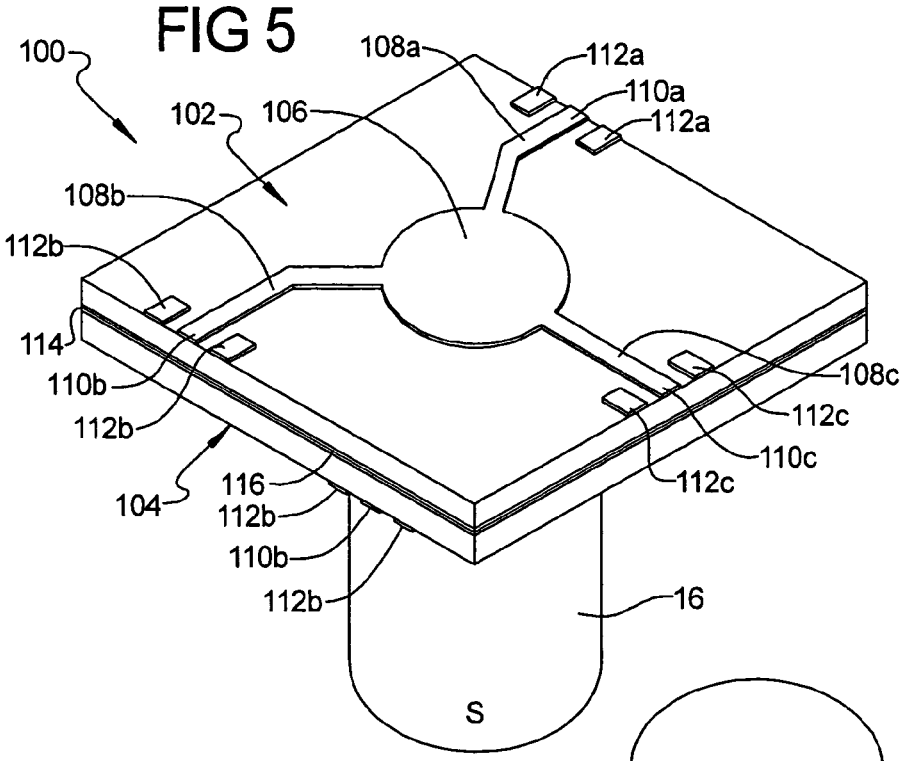
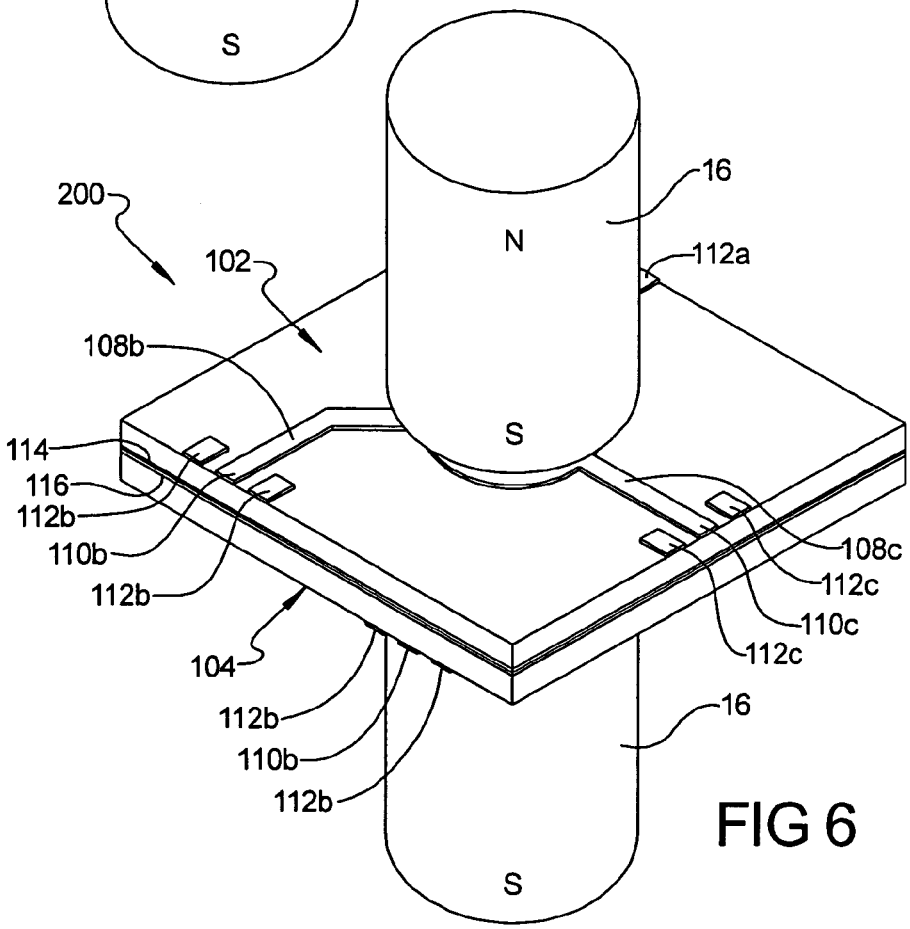
FIG 6

FIG 7
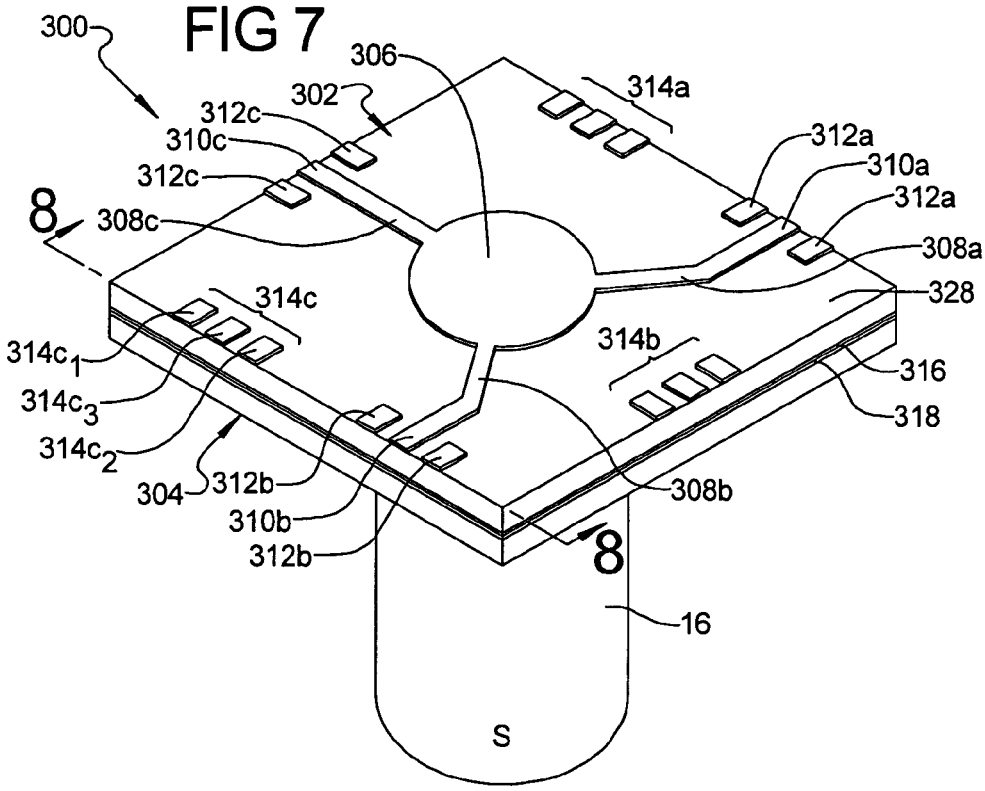
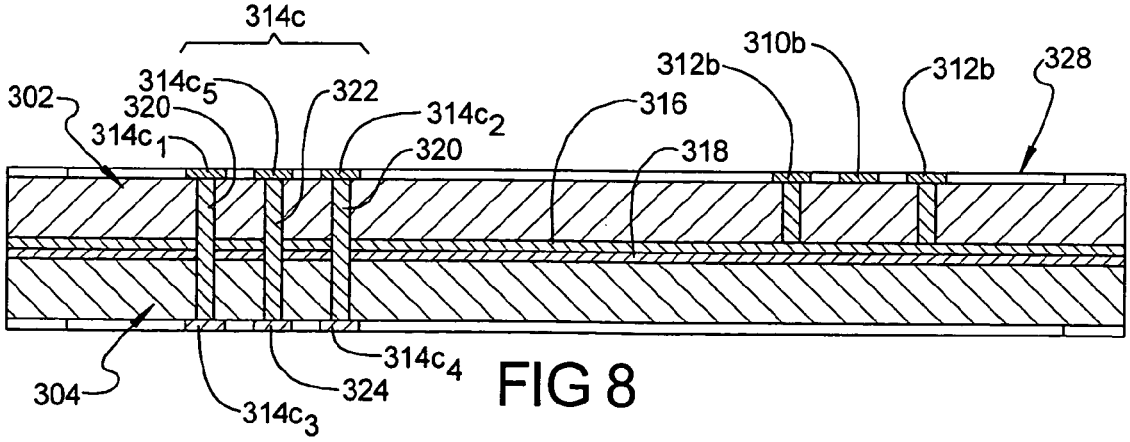
FIG 8

MULTI-CHANNEL CIRCULATOR/ISOLATOR APPARATUS AND METHOD

This invention was made with Government support under contract number NRO-000-02-C-0343 awarded by National Reconnaissance Office. The Government has certain rights in this invention.

FIELD OF THE INVENTION

The present invention relates to circulators and isolators used in RF devices, and more particularly to a multi-channel circulator or isolator having a packaging configuration especially well suited for use with phased array antenna systems and other RF devices where space and packaging limitations preclude the use of conventional circulators or isolators.

BACKGROUND OF THE INVENTION

In phased array antennas, radar systems and various other forms of electronic sensor and communications systems or subsystems, ferrite circulators and isolators provide important functions at RF front end circuits of such systems. Typically, such devices, which can be broadly termed "non-reciprocal electromagnetic energy propagation" devices, are used to restrict the flow of electromagnetic wave energy to one direction only to/from an RF transmitter or RF receiver subsystem. Circulators and isolators can also be used for directing transmitting and receiving electromagnetic energies into different channels and as frequency multiplexers for multi-band operation. Other applications involve protecting sensitive electronic devices from performance degradation or from damage by blocking incoming RF energy from entering into a transmitter circuit.

A conventional microstrip circulator device consists of a ferrite substrate with RF transmission lines metallized on the top surface to form three or more ports. A ground plane is typically formed on the backside of the substrate, as illustrated in FIGS. 1 and 2. The device can also be formed in a stripline configuration in which the transmission line circuit is sandwiched by two ferrite substrates with the ground planes on both the top and the bottom surfaces. An isolator is simply a circulator with one of the three ports terminated by a load resistor.

A circulator device uses the gyromagnetic properties of the ferrite material, typically yttrium-iron-garnet (YIG), for its low loss microwave characteristics. The ferrite substrate is biased by an external, static magnetic field from a permanent magnet. The magnetic lines of flux in the ferrite substrate propagate in only one circular direction, thus forming a non-reciprocal path for electromagnetic waves to propagate, as indicated by arrows in FIG. 1. The higher the operating frequencies, however, the stronger the biasing field that is required, which necessitates a stronger magnet.

A phased array antenna is an antenna formed by an array of individual active module elements. In applications involving phased array antennas, each radiating/reception element can use one or more such ferrite circulators or isolators in the antenna module. However, incorporating any device into the already limited space available on most phased array antennas can be an especially challenging task for the antenna designer. The space limitations imposed in phased array antennas is due to the fact that the spacing of the radiating reception elements of the array is determined in part by the maximum scan angle that the antenna is required to achieve, and in part by the frequency at which the antenna is required to operate. For high performance phased array antennas, this spacing is typically close to one half of the wave length of the electromagnetic waves being radiated or received. For example, a 20 GHz antenna would have a wavelength of about 1.5 cm or 0.6 inch, thus an element spacing of merely 0.75 cm or 0.3 inch. This spacing only gets smaller as the antenna operating frequency increases. Complicating matters further, the size of the ferrite circulator/isolator does not scale down as the operating frequency increases because of the need for a stronger permanent magnet with the increasing operating frequency. The need for a stronger permanent magnet is harder to meet due to material constraints. Accordingly, the packaging of a conventional circulator/isolator becomes more and more difficult and challenging within phased array antennas as the operating frequency of the antenna increases or its performance requirements (i.e., scan angle requirement) increases. These same packaging limitations are present in other forms of RF devices where there is simply insufficient space to accommodate a conventional circulator or isolator.

Accordingly, it would be highly desirable to provide a circulator or isolator capable of being used with multiple RF channels in a device where the packaging constraints of the device would ordinarily not permit the use of a conventional circulator or isolator.

SUMMARY OF THE INVENTION

The present invention is directed to a multi-channel, non-reciprocal electromagnetic wave propagation system and method that is able to function in a multi-channel RF device where packaging constraints would ordinarily make it difficult or impossible to incorporate such a device. In one form the apparatus includes a circulator having a pair of spaced apart ferrite substrates with a magnet sandwiched between the substrates. Each substrate has conductive traces formed on at least one of its surfaces that form a plurality of distinct ports. Each of the substrates may be associated with a separate channel in the RF device into which the circulator/isolator is incorporated. A single magnet, in one preferred form a permanent magnet, provides the magnetic lines of flux through each of the ferrite substrates that enable two independent circulator channels to be formed in a highly compact configuration.

In another preferred form first and second ferrite substrates are positioned closely adjacent one another and are sandwiched between a pair of permanent magnets. In still another configuration, first and second substrates are positioned closely adjacent one another with only a single permanent magnet positioned against a surface of one of the ferrite substrates.

In further embodiments one or more of the ferrite substrates may incorporate metallic vias that allow all electrical connections to be formed on one surface of one of the substrates.

In each of the above described embodiments, a multi-channel, non-reciprocal electromagnetic wave propagation device is formed in a compact configuration that is suitable for many applications where space/packaging limitations would ordinarily make it difficult, or impossible, to incorporate a circulator/isolator.

The features, functions, and advantages can be achieved independently in various embodiments of the present inventions or may be combined in yet other embodiments.

BRIEF DESCRIPTION OF THE DRAWINGS

The present invention will become more fully understood from the detailed description and the accompanying drawings, wherein:

FIG. 3 is a perspective view of a multi-channel circulator/isolator in accordance with a preferred embodiment of the present invention;

FIG. 4 is a side cross sectional view of a portion of one of the substrates of the circulator/isolator shown in FIG. 3, taken in accordance with section line 4-4 in FIG. 3;

FIG. 5 is a perspective view of an alternative preferred embodiment of the circulator/isolator incorporating two closely adjacently positioned substrates and a single permanent magnet;

FIG. 6 is an alternative preferred form of the circulator/isolator shown in FIG. 5 in which a pair of permanent magnets are disposed on opposite surfaces of the pair of closely positioned substrates to sandwich the substrates between the magnets;

FIG. 7 is another alternative preferred embodiment of the circulator/isolator in which all of the bondwire pads are located on one surface of one of the substrates;

FIG. 8 is a cross sectional side view of just the pair of substrates taken in accordance with section line 8-8 in FIG. 7;

DETAILED DESCRIPTION OF THE PREFERRED EMBODIMENTS

Figure 1:
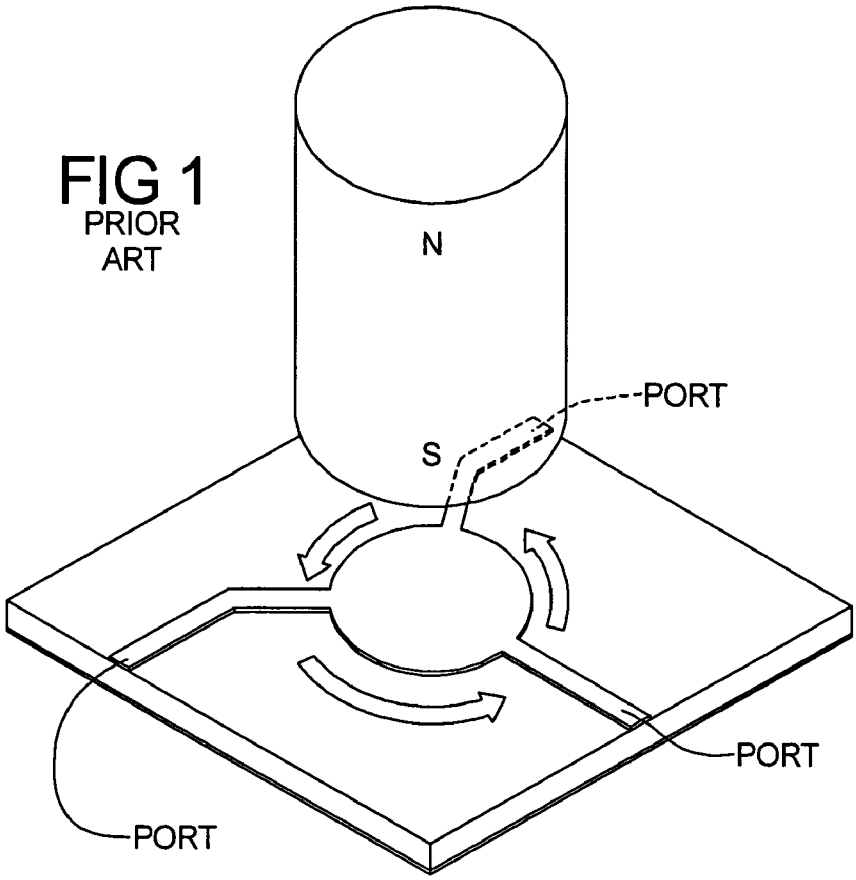
FIG 1 PRIOR ART
FIG. 1 is a top perspective view of a prior art circulator/isolator with a permanent bar magnet shown separated from one surface of a substrate.
Figure 2:
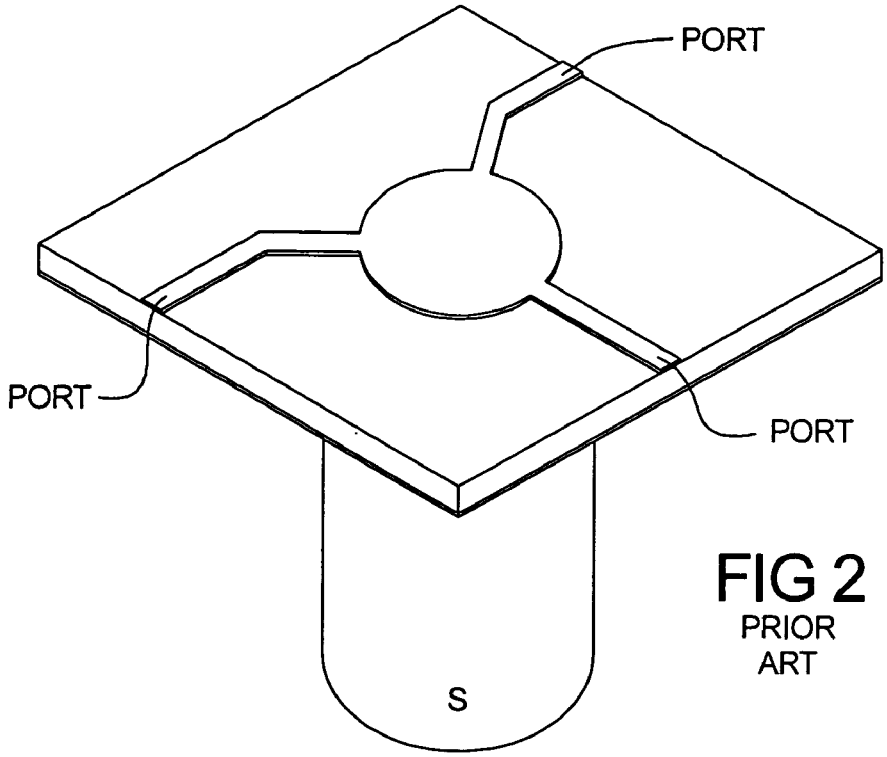
FIG 2 PRIOR ART
FIG. 2 is a perspective view of a prior art circulator/isolator showing a permanent bar magnet mounted on the opposite surface of its substrate.

The following description of the preferred embodiment(s) is merely exemplary in nature and is in no way intended to limit the invention, its application, or uses.

Referring to FIG. 3, a preferred embodiment of a multi-channel, non-reciprocal electromagnetic wave energy propagation apparatus is shown. The apparatus forms a circulator/isolator 10. The circulator/isolator 10 generally includes a first substrate 12 and a second substrate 14 positioned adjacent one another, and a permanent magnet 16 positioned between the substrates 12 and 14. In one preferred form the substrates 12 and 14 comprise yttrium iron garnet ferrite substrates that are formed in a planar configuration. Other suitable materials for the substrates 12 and 14 could be other types of ferrites such as Spinel or hexagonal, depending on the required operational frequency and other performance parameters. Ferrites are ideal for use in the preferred embodiments because they are ferromagnetic, are susceptible to induction, are non-conductive, and are low loss materials.

Substrate 12 includes an upper surface 17 and a lower surface 18. Upper surface 17 includes a metallized surface portion 20 having a plurality of legs that form RF transmission lines 22*a*, 22*b* and 22*c*. An edge portion 24*a*-24*c* associated with each port 22*a*-22*c* forms a "port". Adjacent each port 24*a* is a pair of metallized bond-wire pads 26*a*-26*c* that form ground pads. Lower surface 18 includes a metallized layer 28 forming a ground plane over preferably all or a majority of its surface. Substrate 14 is constructed in identical fashion to substrate 12 and is flipped 180° from the orientation of substrate 12 so that its lower surface is visible in FIG. 3. In general, the magnetic flux field created by the permanent magnet 16 causes the ferrite substrate 12 to provide paths for RF energy to flow in only one circular direction between the ports 22*a*-22*c*. For example, in FIG. 3, electromagnetic wave energy would only be able to flow in one direction between RF transmission lines 22*a* and 22*b*. Likewise, electromagnetic wave energy would only be able to flow in one direction between RF transmission lines 22*b* and 22*c*. Similarly, electromagnetic wave energy would only be able to flow in one direction between RF transmission lines 22*a* and 22*c*. The apparatus 10 shown in FIG. 3 can be configured as an isolator by electrically coupling one or more load resistors 30 to one of the ports 24*a*-24*c* as indicated in FIG. 3. In this instance electromagnetic wave energy would only be able to flow from 22*b* to 22*c*, but not in the opposite direction. The direction of the energy propagation would be reversed when the permanent magnet's polarization direction is reversed.

The ferrite substrates 12 and 14 each can vary in dimensions, but in one preferred implementation for the Ku band frequency each is approximately 0.28 inch (7.1 mm) in length and width and has an overall thickness of approximately 0.02 inch (0.5 mm). The magnet 16 may also vary in dimensions depending upon the strength of the magnetic field that is needed. In one form, however, the magnet 16 has a height of about 0.1 inch (2.5 mm) and a diameter of about 0.1 inch (2.5 mm). While shown as a circular magnet, the magnet 16 could comprise other shapes such as triangular, rectangular, octagonal, etc. The magnetic field strength of the magnetic 16 may vary considerably to suit a specific application, but in one preferred implementation is between about 1000 Gauss-3000 Gauss. For millimeter wave applications (30 GHz-60 GHz), the strength of the magnetic field may need to be as high as about 10,000 Gauss. Any magnet that can provide such field strengths without affecting the microwave fields (thus being non-conductive) could be used. Electromagnets could potentially be used but their typical size and bulk may make them impractical for many applications. Permanent bar magnets are widely available commercially from a number of sources.

Referring to FIG. 4, the substrate 12 can be seen to include a pair of metallized vias 26$c_1$. The vias 26$c_1$ electrically couple to the ground plane 28 and to the ground pads 26*c*.

Referring to FIG. 5, an alternative preferred circulator 100 is shown. The circulator 100 could be implemented as an isolator simply by attaching one resistor to one of its ports, as explained in connection with circulator/isolator 10. Circulator 100 includes a pair of ferrite substrates 102 and 104 that are positioned against one another. Substrates 102 and 104 each are identical in construction to substrates 12 and 14 of the circulator/isolator 10. Thus, substrate 102 includes a metallized surfaced 106 forming a plurality of RF transmission lines 108*a*, 108*b* and 108*c* that provide ports 110*a*, 110*b* and 110*c*, respectively. Ground pads 112*a*, 112*b* and 112*c* are associated with ports 110*a*-110*c*, respectively. A ground plane 114 is formed on a lower surface of the substrate 102. Substrate 104 is formed identically to substrate 102 and its ground plane 116 is positioned in contact with ground plane 114. Magnet 16 is positioned against an outer surface of substrate 104 to provide a magnetic flux field that extends through each of the substrates 102 and 104 to provide the gyro-magnetic field lines. Substrates 102 and 104 effectively form a multi-channel circulator that can be more effectively packaged in electronic devices where space is limited.

In FIG. 6, a circulator 200 is illustrated in accordance with another alternative preferred embodiment of the invention. Circulator 200 is essentially identical to circulator 100 but with the addition of a second magnet 16 disposed against substrate 102. Each of the substrates 102 and 104 are thus sandwiched between magnets 16. The use of two magnets provides a stronger and more uniformly distributed magnetic flux field through the substrates 102 and 104.

Referring to FIG. 7, a circulator 300 in accordance with another alternative preferred embodiment of the invention is shown. Circulator 300 also forms a multi-channel circulator through the use of two adjacently positioned substrates 302 and 304 that are substantially identical in construction to substrates 102 and 104 shown in FIG. 6. Each substrate includes a metallized area 306 that forms RF transmission lines 308*a*, 308*b* and 308*c*. Each of RF transmission lines 308*a*-308*c* has an edge portion forming a port 310*a*-310*c*, respectively. Ground pads 312*a*, 312*b* and 312*c* are associated with ports 310*a*-310*c*, respectively.

The principal difference between the circulator 300 and the circulator 200 is the addition of bond pad groups 314 on the exposed surface of the substrate 302. Bond pads groups 314 allow all wire connections to the circulator 300 to be formed at an upper surface 328 of substrate 302. The construction of the substrates 302 and 304 can be seen in additional detail in FIG. 8. Substrate 302 includes a metallized layer 316 and substrate 304 includes a metallized layer 318. The layers 316 and 318 form ground planes that are disposed against one another. Metallized vias 320 form conductive paths extending through the thicknesses of substrates 302 and 304 to electrically couple with pads 314$C_3$ and 314$C_4$. Vias 320 are also electrically coupled to pads 314$C_1$ and 314$C_2$. A third via 322 extends through substrates 302 and 304, and is electrically coupled to a metallized RF transmission line 324 forming one of the three RF transmission lines on substrate 304. The via 322 is coupled to electrical contact pad 314$C_5$ Thus, an electrical connection to the RF transmission line 324 is provided at upper contact pad 314$C_5$.

Figures 9, 11:
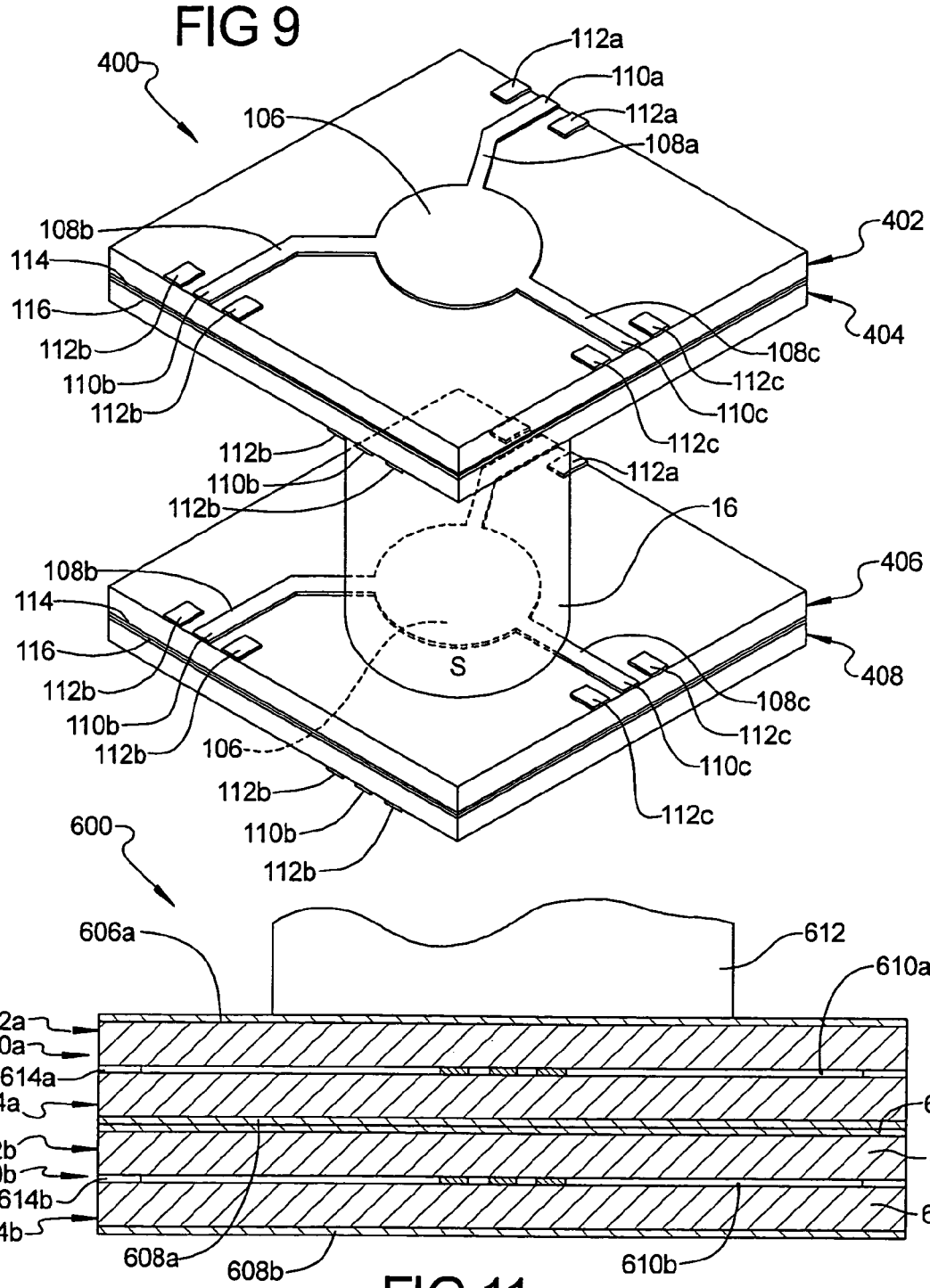
FIG. 9 is a perspective view of another alternative preferred form of the circulator/isolator that incorporates a single permanent magnet for providing the magnetic field to each one of a pair of multi-channel substrates.
FIG. 11 is a side cross-sectional view of an alternative embodiment of the present invention implemented in a stripline configuration.

In FIG. 9, a circulator 400 is shown in accordance with another alternative embodiment. Circulator 400 includes ferrite substrates 402 and 404 positioned adjacent one another, and a second pair of substrates 406 and 408 positioned adjacent one another. Substrate pair 402/404 is identical in construction to substrates 102 and 104 of circulator 100, and forms two channels. Substrate pair 406/408 is also identical in construction to substrates 102 and 104 and also forms two channels. Magnet 16 is positioned between the two pairs of substrates 402, 404 and 406, 408. Circulator 400 thus forms a four-channel circulator in one integrated package. The circulator 400 is especially well suited for accommodating phased arrays that require packaging two radiating/receiving elements with two circulator channels per element in a limited space. Although not shown, a pair of additional magnets could be disposed, one against substrate 402 and the other against substrate 408, depending on the RF performance requirements needed. In some applications, the additional two magnets may be needed to provide the required field strength inside the areas of interest.

Figure 10:
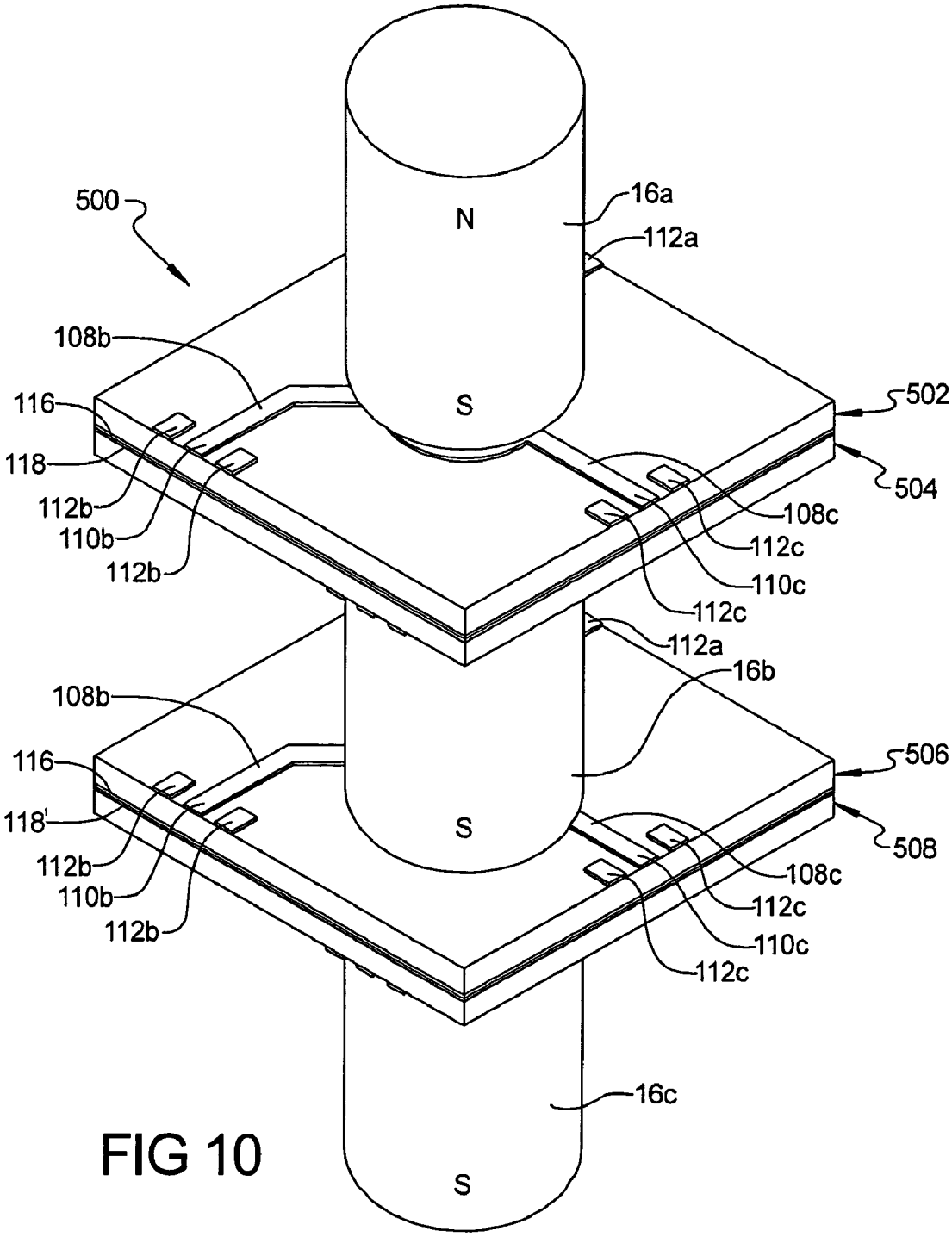
FIG. 10 is a view of still another alternative preferred embodiment of a circulator/isolator in which an additional pair of magnets are incorporated over the single magnet of the embodiment in FIG. 9 to provide an even stronger magnetic field to each of the pair of substrates.

Referring to FIG. 10, a circulator 500 in accordance with still another alternative preferred embodiment of the invention is shown. Circulator 500 is similar to circulator 400 in that it includes a first pair of ferrite substrates 502 and 504, in addition to a second pair of ferrite substrates 506 and 508. Each pair of substrates 502,504 and 506,508 is identical in construction to substrate 102 and 104. However, three magnets 16 are employed rather than just one. Magnets 16*a* and 16*b* provide the flux field for substrate pair 502, 504, while magnets 16*b* and 16*c* provide the flux field for substrates 506, 508. Circulator 500 thus also forms a four channel circulator but with even stronger and more uniformly distributed magnetic fields provided through each of the substrate pairs 502/504 and 506/508.

All of the circulator embodiments described herein make use of microstrip type RF transmission line circuits formed on one of the surfaces of each substrate. However, the various embodiments described above can be implemented in a similar manner for a stripline circulator. In FIG. 11, a cross-sectional side view of a dual channel, stripline circulator 600 is illustrated. The circulator 600 has two pairs of substrates 600*a* and 600*b*. Substrate 600*a* has an upper ferrite substrate 602*a* and a lower ferrite substrate 604*a*. Substrate 602*a* includes a metal ground plane 606*a* and substrate 604*a* includes a metal ground plane 608*a*. A metallized surface 610*a* is formed on one of the substrates 602*a* or 604*a* so that the metallized surface 610*a* is sandwiched between the two substrates 602*a* and 604*a* when the circulator 600 is assembled. Substrate pair 600*b* is constructed identical to 600*a*, and common reference numerals, but with a "b" suffix, are used to designate common components. At least one permanent magnet 612 is disposed against one of the ground planes 606*a* or 608*b*. Optionally, two separate permanent magnets could be positioned against both exposed ground planes 606*a* and 608*b*. Edge portion 614*a* forms one of a plurality of ports provided by the metallized surface 610*a* in a manner identical to metallized surface 106 of circulator 100. Edge portion 614*b* forms another port. The circulator 600 can be provided in accordance with one or more of the previously described embodiments shown in FIGS. 3-10.

Figure 12:
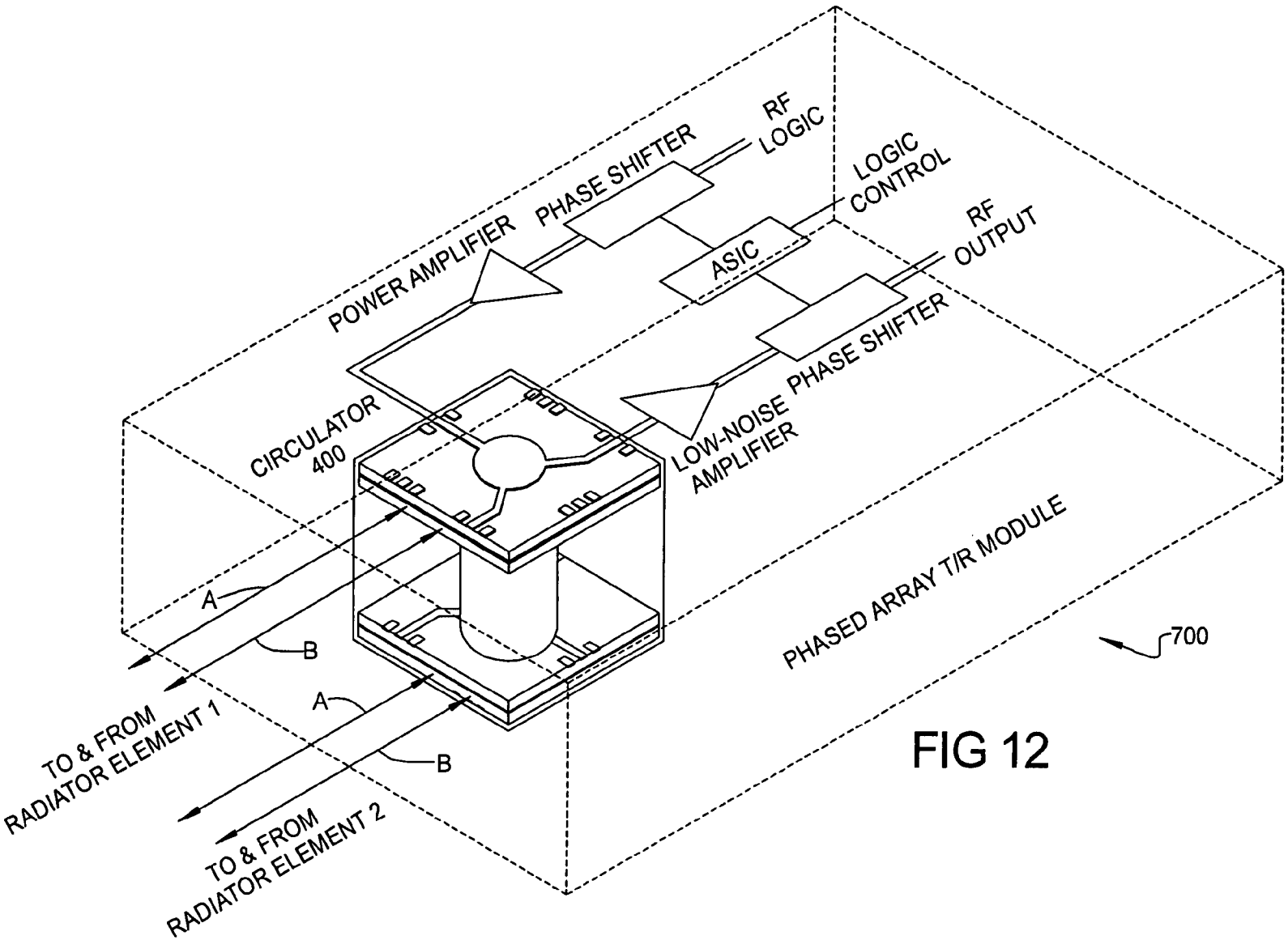
FIG. 12 is a perspective view of the apparatus of FIG. 10 incorporated into a portion of a multi-channel phased array antenna.

Referring to FIG. 12, the circulator 400 is illustrated as being implemented in an exemplary phased array antenna 700. The circulator 400, in practice, is electrically coupled to a pair of radiator elements. This enables a pair of channels (A and B) to be formed for each radiator element to provide a dual beam antenna. Other specific phased array antenna embodiments and teachings are incorporated in the following patents owned by The Boeing Company: U.S. Pat. Nos. 6,714,163; 6,670,930; 6,580,402; 6,424,313, as well as U.S. application Ser. No. 10/625,767, filed Jul. 23, 2003 and U.S. application Ser. No. 10/917,151, filed Aug. 12, 2004, all of which are incorporated by reference into the present application.

The circulator/isolator of the present invention thus forms a means for providing a multi-channel circulator for use in phased array antennas and other RF devices where space and packaging constraints make the implementation of a circulator difficult and/or impossible.

While various preferred embodiments have been described, those skilled in the art will recognize modifications or variations which might be made without departing from the inventive concept. The examples illustrate the invention and are not intended to limit it. Therefore, the description and claims should be interpreted liberally with only such limitation as is necessary in view of the pertinent prior art.

What is claimed is:

1. A multi-channel, non-reciprocal, microstrip, electromagnetic wave propagation apparatus comprising:

a first ferromagnetic substrate forming a first energy propagation channel, and having a plurality of RF transmission traces on a first surface and a ground plane on a second surface, one of said traces forming an input port and a different one of said traces forming an output port;

a second ferromagnetic substrate forming a second energy propagation channel, and having a plurality of RF transmission traces on a first surface and a ground plane on a second surface, one of said traces on said second substrate forming an input port and a different one of said traces on said second substrate forming an output port;

the first and second ferromagnetic substrates placed against one another so that their respective said ground planes are facing one another and in abutting contact; and a magnet disposed against one of said first and second substrates so as to be disposed against said RF transmission traces of said one substrate, to excite a circular, unidirectional magnetic flux field in each of the substrates that limits electromagnetic wave propagation to one direction only in each said energy propagation channel.

2. The apparatus of claim 1, further comprising an additional magnet disposed against one of said surfaces of said substrates such that said substrates are sandwiched between said magnet and said additional magnet.

3. The apparatus of claim 1, further including:

at least one via extending through said first substrate and in electrical communication with the ground plane of said second substrate; and an electrical contract pad disposed on said first surface of said first substrate.

4. The apparatus of claim 1, wherein at least one of said substrates comprises a planar, disc-like shape.

5. The apparatus of claim 1, wherein one of said RF transmission traces is coupled to a load resistor to configure the circulator to operate as an isolator.

6. The apparatus of claim 1, further comprising an additional magnet disposed adjacent said substrates such that at least one of said substrates is sandwiched between said magnet and a first surface of said additional magnet.

7. The apparatus of claim 6, further comprising a third substrate adjacent a second surface of said additional magnet.

8. The apparatus of claim 6, further comprising:

at least one via extending through said first substrate;

an electrical contact pad formed on said first surface of said first substrate and in electrical communication with said ground plane formed on said second surface of said first substrate.

9. A method for forming a compact, multi-channel, non-reciprocal electromagnetic wave, microstrip energy propagation device, comprising:

forming a first non-reciprocal propagation channel on a first ferromagnetic substrate;

forming a second non-reciprocal propagation channel on a second ferromagnetic substrate;

forming a ground plane on a surface of said first ferromagnetic substrate that is opposite to a surface on which said first non-reciprocal propagation channel is formed;

disposing said substrates against one another so that said ground plane is sandwiched between said substrates; and securing a magnet against one of said first and second substrates, and overlaying one of said non-reciprocal propagation channels, to simultaneously excite circular, unidirectional magnetic flux fields in each of said substrates to facilitate electromagnetic wave energy propagation in one direction only in each of said substrates.

10. The method of claim 9, further comprising using an additional magnet disposed against one of said substrates such that said first and second substrates are sandwiched between said magnet and said additional magnet.

11. The method of claim 9, further comprising forming an electrically conductive via through a thickness of said first substrate and electrically coupling said via to at least one of a RF transmission trace and a ground plane formed on said second substrate.

12. The method of claim 9, further comprising using a load coupled to one of said RF transmission traces to configure said device to operate as an isolator.

13. The method of claim 9, further comprising forming said first substrate with an electrically conductive via through its thickness.

14. The method of claim 13, further comprising forming an electrical contact pad on a first surface of said first substrate in communication with said via.

* * * * *